US005597122A

United States Patent [19]

Eisenmann

[11] Patent Number: 5,597,122

[45] Date of Patent: Jan. 28, 1997

[54] FLAT JET NOZZLE FOR A HIGH-PRESSURE CLEANING DEVICE

[75] Inventor: Wilhelm Eisenmann, Althütte, Germany

[73] Assignee: Alfred Karcher GmbH & Co., Winnenden, Germany

[21] Appl. No.: 500,999

[22] PCT Filed: Feb. 5, 1994

[86] PCT No.: PCT/EP94/00330

§ 371 Date: Oct. 2, 1995

§ 102(e) Date: Oct. 2, 1995

[87] PCT Pub. No.: WO94/17921

PCT Pub. Date: Aug. 18, 1994

[30] Foreign Application Priority Data

Feb. 9, 1993 [DE] Germany ..... 43 03 762.3

[51] Int. Cl.[6] ..... B05B 1/04

[52] U.S. Cl. ..... 239/589; 239/597

[58] Field of Search ..... 239/589, 597, 239/598, 599, 594, 592, 566

[56] References Cited

U.S. PATENT DOCUMENTS

| | | | |
|---|---|---|---|
| 2,701,412 | 2/1955 | Wahlin | 239/599 X |
| 2,745,701 | 5/1956 | Wahlin | 239/597 |
| 2,985,386 | 5/1961 | Steiwen | 239/597 |
| 3,659,787 | 5/1972 | Ito | 239/599 X |

FOREIGN PATENT DOCUMENTS

| | | | |
|---|---|---|---|
| 554493 | 1/1957 | Belgium . | |
| 2724173 | 11/1978 | Germany | 239/599 |
| 3414880 | 10/1985 | Germany . | |
| 1212596 | 2/1986 | U.S.S.R. | 239/597 |
| 2157592 | 10/1985 | United Kingdom . | |

*Primary Examiner*—Kevin Weldon
*Attorney, Agent, or Firm*—Barry R. Lipsitz

[57] ABSTRACT

In order to obtain a flat jet having a particularly uniform distribution of pressure in a flat jet nozzle for a high-pressure cleaning device with an outlet opening and a flow channel arranged upstream of and opening into this outlet opening, it is suggested that the flow channel and the outlet opening have a circular cross section transversely to the direction of flow and be arranged concentrically to one another, that the flow channel narrow conically in the direction of flow and merge into a circular-cylindrical section located upstream in front of the outlet opening, the end of this section forming the outlet opening, and that pocket-like extensions of the flow channel be arranged on diametrally opposite sides of the flow channel in the region where the conical section of the flow channel merges into the circular-cylindrical section, these extensions being arranged and designed symmetrically to one another, extending essentially over the entire diameter of the circular-cylindrical section and having a deflecting surface conducting part of the liquid flowing through the conical section essentially transversely into the cylindrical section.

20 Claims, 2 Drawing Sheets

FLAT JET NOZZLE FOR A HIGH-PRESSURE CLEANING DEVICE

Figure 1:
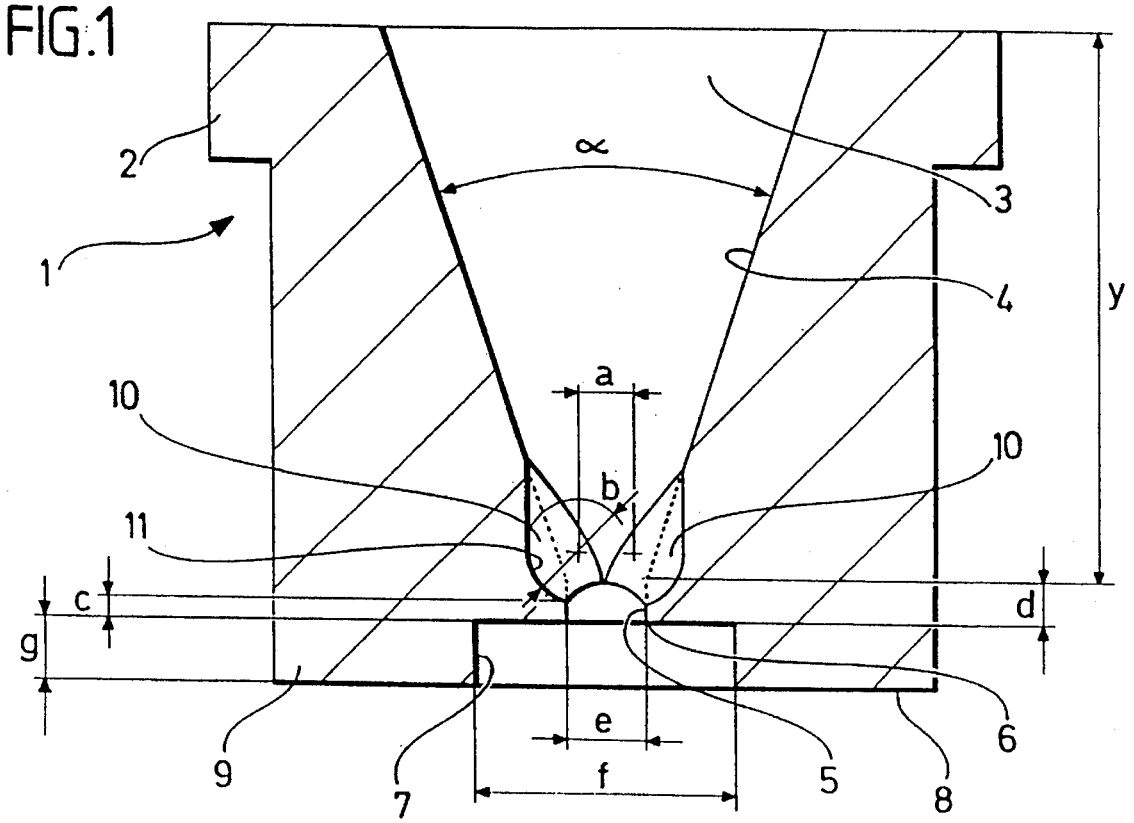

The invention relates to a flat jet nozzle for a high-pressure cleaning device having an outlet opening and a flow channel with a circular cross section arranged concentrically and upstream of and opening into this outlet opening the flow channel narrowing conically in the direction of flow and merging into a circular-cylindrical section located upstream in front of the outlet opening, the end of this section forming the outlet opening, wherein pocket-like extensions of the flow channel are arranged on diametrally opposite sides of the flow channel in the region where the conical section of the flow channel merges into the circular-cylindrical section, these extensions being arranged and designed symmetrically to one another and having a deflecting surface conducting part of the liquid flowing through the conical section essentially transversely into the cylindrical section.

Flat jet nozzles are used in order to be able to sweep over surfaces to be cleaned in sections with a cleaning jet which is spread fanwise and which is, on the one hand, intended to have a uniform cleaning action as far as possible over the entire width of the jet and, on the other hand, is intended to maintain this cleaning action as far as possible over different distance ranges of the nozzle from the surface to be cleaned. For this purpose, it is necessary for the flat jet to be fanned out as little as possible transversely to the direction of fanning; moreover, the distribution of pressure in the interior of the jet must be designed such that the impact speeds of the liquid are constant as far as possible over the entire cross section.

This can often not be achieved with conventional flat jet nozzles which have slit-shaped or elliptical outlet openings (GB-A-2 157 592; BE-A-554 493)—after "openings". In many cases, the impact pressure of the liquid in the center of the jet is considerably greater than in the peripheral regions; moreover, the jet is often fanned out transversely to the actual fanning direction.

The object of the invention is to design a flat jet nozzle of the generic type such that a flat jet results which achieves cleaning actions which are as uniform as possible over its cross section, whereby this cleaning action is maintained as far as possible over a greater distance range from the surface to be cleaned.

This object is accomplished in accordance with the invention, in a flat jet nozzle of the type described at the outset, in that the the outlet opening has a circular cross section transversely to the direction of flow and that the pocket-like extensions extend essentially over the entire diameter of the circular-cylindrical section.

Surprisingly, it has been found that a flat jet can be generated with the desired characteristics when both the flow channel in the nozzle and the outlet opening have a circular cross section, i.e. when they are not designed according to the idea of the elongate outlet opening but, on the contrary, are designed in the manner customarily used in the production of rotationally symmetrical compact jets. In this respect, the compact jet is converted into a flat jet spread fanwise by the deflecting surfaces which are arranged in the lateral extensions, conduct part of the quantity of liquid from opposite sides transversely into the compact jet and hereby deform the jet and fan it out transversely to the direction of introduction. Despite the use of a rotationally symmetrical flow channel and a rotationally symmetrical outlet opening, a fanning out of the jet results, whereby the jet is compressed in the direction at right angles to its fanning out, i.e. a fanning out transversely to the actual direction of fanning is successfully avoided. The jet is, in practice, compressed between the branch streams entering it from the side and is prevented from fanning out in one direction whereas it is fanned out in a plane extending at right angles thereto.

In this respect, it is important for a flow behavior to be formed in the interior of the nozzle by the conically narrowing section which is particularly suitable for such a deformation of the compact jet by means of lateral recesses. The arrangement of the recesses in the region of transition between a conical section and a circular-cylindrical section results in the desired jet configuration as described. Although the behavior of the flow is not clarified in every detail, it seems to be that due to the conical section the liquid flowing in is formed particularly effectively into a compact and laminarly flowing jet which can be deformed particularly effectively due to laterally deflected branch streams.

The pressure profile generated by a flat jet generated in this manner is particularly remarkable. It has, for example, been found that essentially constant pressure values occur over the entire cross section of the flat jet and in the outermost peripheral regions the pressure is slightly increased above this constant pressure in the remaining cross section, i.e. in the outermost peripheral region a somewhat increased, very sharply delimited cleaning action results. When sweeping over a surface to be cleaned with such a jet, it is possible to achieve completely uniform cleaning results on the entire strip covered by the jet; in the peripheral region a particularly effective cleaning off results which is also visible to the eye of the user and so a larger surface area can be cleaned completely uniformly and effectively when the user causes cleaning strips to be directly adjacent to one another. It is not necessary for certain areas to be covered several times. Moreover, this cleaning action occurs in the same manner over a larger area seen in the direction of flow.

A preferred embodiment provides for the angle of opening of the conical section to be between 10° and 90°, preferably between 30° and 50°.

The deflecting surface may, as such, have various geometrical configurations; the essential point is that a stream of liquid flowing in essentially parallel to the circular-cylindrical section of the flow channel is deflected and following the deflection enters essentially transversely into the cylindrical section of the flow channel. A design is particularly advantageous, in which the deflecting surface is a spherical part surface. In this respect, the spherical part surface can advantageously adjoin a part surface of a circular cylinder or truncated cone extending parallel to the longitudinal direction of the flow channel. Such an extension may be produced in a simple manner when cylindrical or conical bores, which are spherical in design at their ends, are introduced into the nozzle body parallel to the cylindrical section of the flow channel and laterally offset thereto.

It is possible to provide for the ratio of the distance of the central points of the spherical deflecting surfaces from one another and the diameter of the outlet opening to be between 0.04 and 3, in particular between 0.04 and 1.5. This ratio is extremely important for the degree of fanning out. When the distance between the central points is slight, the volume of the pocket-like recesses is slight, i.e. the volume of flow of the branch streams deflected laterally into the main jet is less and so the resulting fanning out is less. The angle of fanning out can, therefore, be controlled via this ratio and becomes larger, the greater the distance of the central points from one another is.

Furthermore, it is advantageous for the ratio of the diameter of the part spherical deflecting surface and the diameter of the outlet opening to be between 1 and 2, preferably between 1.1 and 1.6. When the diameter of the part spherical deflecting surface is smaller than the diameter of the outlet opening, the main jet will not fan out but divide into two branch jets. When, on the other hand, the diameter of the part spherical deflecting surface is more than twice as large as the diameter of the outlet opening, the deformation of the main jet clearly decreases, i.e. the fanning out becomes less. The main jet then increasingly approximates a rotationally symmetrical compact jet.

Furthermore, it is advantageous for the length of the cylindrical section of the flow channel between the junction of the lowest point of the deflecting surface and the end of the cylindrical section to be between 5% and 30% of the diameter of the outlet opening. The cylindrical section of the flow channel therefore ends close to the junction of the deflecting surfaces so that relatively large fanning angles of the jet are also possible without the outlying parts of the jet being hindered by the inner wall of the cylindrical section.

The length of the conical section of the flow channel as far as the transition into the circular-cylindrical section preferably corresponds to 5 to 20 times the diameter of the outlet opening. Therefore, a relatively long conical section is provided which concentrates and accelerates the flow into the circular-cylindrical section of the flow channel.

In a preferred embodiment, the length of the circular-cylindrical section corresponds to 0.1 to 1 times the diameter of the outlet opening.

It is favorable for the outlet opening to be surrounded by a protective ring downstream of and in spaced relation to the outlet opening, the inside diameter of this ring preferably corresponding to 1.5 to 10 times the diameter of the outlet opening. This protective ring does not in any way hinder the flat jet from exiting the outlet opening but does stabilize it in relation to air swirls etc. and so the outlet opening is set back in relation to the end face of the nozzle body.

The length of this protective ring in the direction of flow can correspond to 0.2 to 5 times the diameter of the outlet opening.

Figure 2:
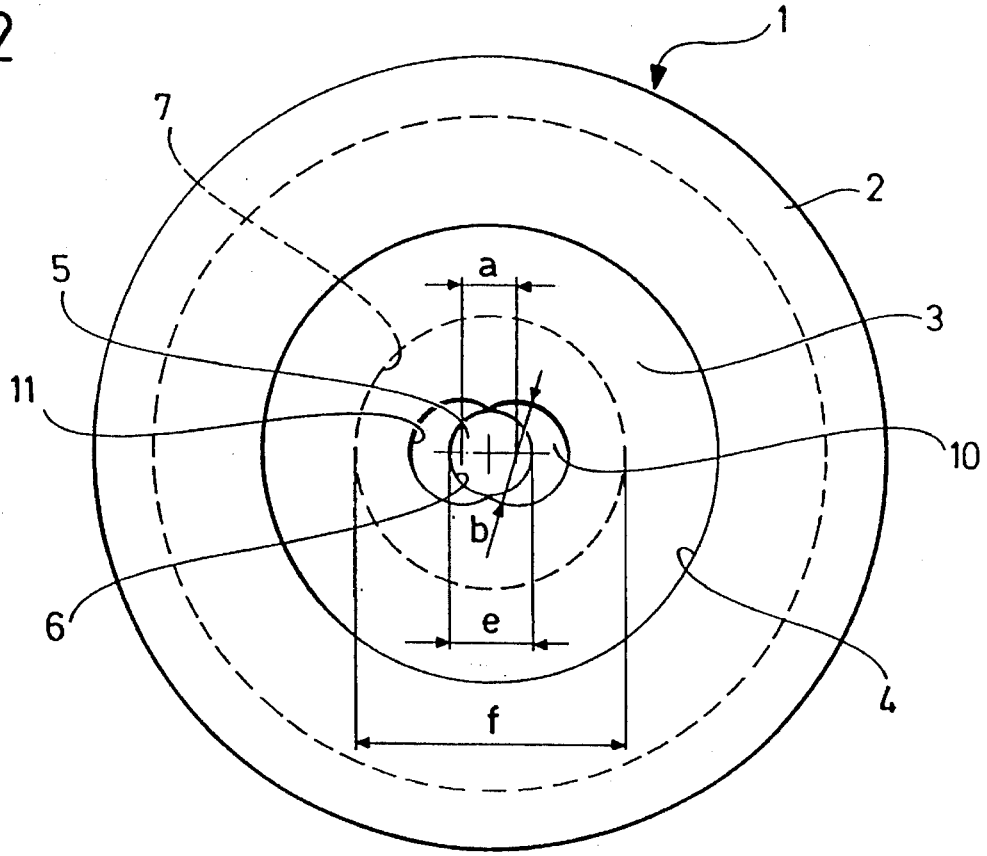
Figure 3:
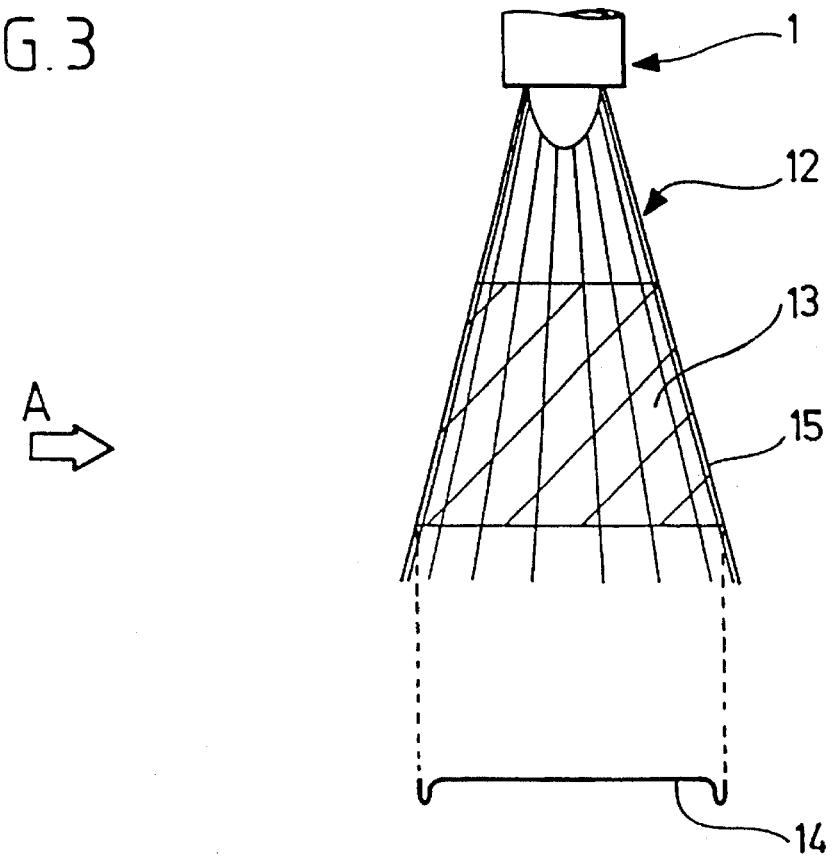
Figure 4:
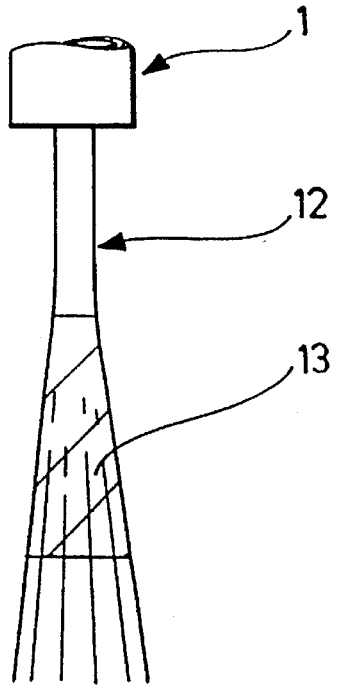

The following description of a preferred embodiment of the invention serves to explain the invention in greater detail in conjunction with the drawings. The drawings show:

FIG. 1: a view in longitudinal section through a nozzle body of a flat jet nozzle;

FIG. 2: a plan view of the nozzle body of FIG. 1 in the direction of flow;

FIG. 3: a schematic side view of the nozzle body of FIG. 1 with a flat jet spread fanwise exiting from it as well as a schematic illustration of the pressure distribution over the entire cross section of the flat jet and FIG. 4: a view similar to FIG. 3 in the direction of arrow A in FIG. 3.

A nozzle body 1 is illustrated in FIGS. 1 and 2 which is essentially circular-cylindrical in design and bears an overhanging annular flange 2 at one end. Such a nozzle body 1 can be connected in any optional manner to a flow supply, for example by a screw collar ring which is not illustrated in the drawing. This ring is pushed over the cylindrical part of the nozzle body 1, is supported on the annular flange 2 and clamps the nozzle body 1 against a jet pipe with a seal as intermediate layer. The nozzle body 1 can also be inserted into a nozzle housing, for example pressed into it or bonded thereto.

The nozzle body can consist of metal, for example of brass or, to increase the resistance to wear and tear, of a hard metal; the use of ceramic or plastic material is also possible.

A flow channel 3 penetrating the nozzle body 1 in longitudinal direction is arranged in this body. The flow channel has on the inflow side a conically narrowing section 4 followed by a circular-cylindrical section 5. This circular-cylindrical section 5 ends in a circular outlet opening 6 which, for its part, opens into a recess 7 which is circular in cross section in the end face 8 of the nozzle body 1. The recess 7 has a larger inside diameter than the outlet opening 6 so that a step-like extension of the flow channel occurs in this region; the recess 7 is surrounded by the nozzle body 1 in the form of a protective ring 9.

In the region of transition between the conically narrowing section 4 and the circular-cylindrical section 5, two pocket-like extensions 10 are arranged on diametrally opposite sides of the flow channel. The extensions are limited in the illustrated embodiment by a surface arranged upstream and forming part of a circular cylinder and by a surface adjoining thereto and forming part of a sphere.

The angle of opening $\alpha$ of the conically narrowing section 4 is between 10° and 90°, preferably between 30° and 50°. The length y of this conically narrowing section 4 corresponds to 5 to 20 times the diameter e of the outlet opening 6. The length d of the circular-cylindrical section 5 corresponds to 0.1 to 1 times the diameter e of the outlet opening 6.

The two pocket-like extensions 10 result from bores inserted parallel to the longitudinal axis of the flow channel and having spherical ends. The distance a of the central points of these spherical surfaces from one another corresponds to 0.04 to 3 times the diameter e of the outlet opening, in particular 0.04 to 1.5, while the diameter b of the part spherical deflecting surface corresponds to 1 to 2 times the diameter e of the outlet opening, preferably 1.1 to 1.6 times.

The deflecting surface of the pocket-like extension opens into the cylindrical section 5 of the flow channel 3 relatively close to the outlet opening 6; the length c of the cylindrical section 5 of the flow channel 3 between the junction of the lowest point of the deflecting surface 11 of the extension 10 and the end of the cylindrical section 5 is preferably between 5% and 30% of the diameter e of the outlet opening 6.

The inside diameter f of the protective ring 9 corresponds to 1.5 to 10 times the diameter e of the outlet opening, the length g of the protective ring 9 in the direction of flow to 0.2 to 5 times the diameter e of the outlet opening.

In preferred embodiments, the diameter e of the outlet opening can, for example, be at 1.6 mm so that possible dimensions for the overall nozzle as described result on the basis of the specified ratios.

The lateral recesses in the area of transition between the conically narrowing section and the cylindrical section result in a fanning out of a jet 12, which exits from the outlet opening 6, in the central plane between the two recesses 10, i.e. transversely to the inflow direction of the deflection surface 11 into the circular-cylindrical section 5. The flare angle of the jet 12 in this plane may be varied, namely, on the one hand, by the distance a of the central points of the extensions 10 from one another, on the other hand, by the diameter b of the spherical deflecting surface 11. Both measures alter the ratio of the main stream of the liquid and the branch streams introduced transversely into this main stream by the extensions 10 and the deflecting surface 11. The larger these branch streams are in relation to the main stream, the greater the main stream will be fanned out.

As is apparent from the illustration in FIGS. 3 and 4, the fanning out results almost exclusively in the central plane between the two extensions 10; transversely thereto, only a very slight fanning out results (FIG. 4) and this occurs only at a certain distance from the outlet opening 6.

In this way, a jet is obtained which is spread fanwise essentially only in one plane and has an essentially constant distribution of pressure over the entire cross section of the jet over a larger distance range 13 which is indicated by crosshatching in FIGS. 3 and 4. The pressure distribution is indicated schematically in FIG. 3 by the pressure distribution curve 14. This curve shows the pressure values over the entire cross section, whereby the pressure values increase downwards. It is apparent from this that in the peripheral regions 15 of the jet 12 a slight increase in the pressure occurs within very narrow limits, i.e. the cleaning action of the flat jet is equally good over the entire cross section right into the outer regions, in the peripheral regions even slightly improved.

Such a balanced cleaning action over the entire cross section makes it possible to operate the cleaning nozzle with a low operating pressure and, nevertheless, achieve perfect cleaning over the entire surface which is acted upon. The reduction in the necessary operating pressure, on the other hand, allows the use of smaller high-pressure pumps, i.e. due to the special configuration of the new flat jet nozzle as described, high-pressure cleaning devices can, altogether, be of a lighter construction; moreover, the energy requirements of such high-pressure cleaning devices are less than for known devices.

It has, furthermore, been found that the use of a circular outlet opening 6 leads to very low wear and tear on the nozzle.

For various uses it is important to have a flat jet which has only a relatively small flare angle. This can also be achieved by suitably varying the distance a and, where necessary, the diameter b of the spherical deflecting surface; for example, fanning angles as small as 4° can be achieved, whereby a flat jet having the cited characteristics does, nevertheless, result.

The nozzle as described can be produced, when using metallic materials, by machine-cutting; in this respect it is particularly favorable for the lateral extensions 10 to be produced by means of bores which are made with the aid of a drill or form cutter having a spherical tip.

In a different embodiment, it is also possible to produce a nozzle body with the basic contours, i.e. with the outer contour and a flow channel with the conically narrowing section 4 and the circular-cylindrical section 5, by machining and to stamp the lateral extensions 10 into this basic contour. In this respect, a tool can, for example, be used with a central tip which engages as centering means in the flow channel 3.

When using other materials, for example plastics, the entire nozzle can be produced by using the injection molding process.

I claim:

1. A flat jet nozzle for a high-pressure cleaning device comprising:

an outlet opening;

a flow channel with a circular cross section arranged concentrically and upstream of and opening into said outlet opening;

said flow channel narrowing conically in the direction of flow and merging into a circular-cylindrical section located upstream in front of said outlet opening, the end of said circular-cylindrical section forming the outlet opening;

wherein pocket-like extensions of the flow channel are arranged on diametrally opposite sides of the flow channel in the region where the conical section of the flow channel merges into the circular-cylindrical section;

said extensions being arranged and designed symmetrically to one another and having a deflecting surface for conducting part of a liquid flowing through the conical section essentially transversely into the cylindrical section;

said outlet opening having a circular cross section transversely to the direction of flow; and the pocket-like extensions together essentially surrounding the circumference of the entire circular-cylindrical section.

2. A flat jet nozzle as defined in claim 1, wherein an angle of opening (α) of the conically narrowing section is between 10° and 90°.

3. A flat jet nozzle as defined in claim 2, characterized in that the angle of opening (α) of the conically narrowing section is between 30° and 50°.

4. A flat jet nozzle as defined in claim 1 wherein the deflecting surface is a spherical part surface.

5. A flat jet nozzle as defined in claim 4, wherein the spherical deflecting surface adjoins a portion of at least one of a circular cylinder and truncated cone extending parallel to the longitudinal direction of the flow channel.

6. A flat jet nozzle as defined in claim 4, wherein the ratio of the distance (a) between central points of the part spherical deflecting surfaces and the diameter (e) of the outlet opening is between 0.04 and 3.

7. A flat jet nozzle as defined in claim 4, wherein the ratio of the distance (a) between the central points of the part spherical deflecting surfaces and the diameter (e) of the outlet opening is between 0.04 and 1.5.

8. A flat jet nozzle as defined in claim 4, wherein the ratio of the diameter (b) of the part spherical deflecting surface and the diameter (e) of the outlet opening is between 1 and 2.

9. A flat jet nozzle as defined in claim 4, wherein the ratio of the diameter (b) of the part spherical deflecting surface and the diameter (e) of the outlet opening is between 1.1 and 1.6.

10. A flat jet nozzle as defined in claim 1, wherein the length (c) of the cylindrical section of the flow channel between the junction of the lowest point of the deflecting surface and end of the cylindrical section is between 5% and 30% of the diameter (e) of the outlet opening.

11. A flat jet nozzle as defined in claim 4, wherein the length (c) of the cylindrical section of the flow channel between the junction of the lowest point of the deflecting surface and end of the cylindrical section is between 5% and 30% of the diameter (e) of the outlet opening.

12. A flat jet nozzle as defined in claim 5, wherein the length (c) of the cylindrical section of the flow channel between the junction of the lowest point of the deflecting surface and end of the cylindrical section is between 5% and 30% of the diameter (e) of the outlet opening.

13. A flat jet nozzle as defined in claim 1, wherein the length (y) of the conically narrowing section of the flow channel as far as its transition into the circular-cylindrical section corresponds to 5 to 20 times the diameter (e) of the outlet opening.

14. A flat jet nozzle as defined in claim 4, wherein the length (y) of the conically narrowing section of the flow channel as far as its transition into the circular-cylindrical section corresponds to 5 to 20 times the diameter (e) of the outlet opening.

15. A flat jet nozzle as defined in claim 5, wherein the length (y) of the conically narrowing section of the flow channel as far as its transition into the circular-cylindrical section corresponds to 5 to 20 times the diameter (e) of the outlet opening.

16. A flat jet nozzle as defined in claim 1, wherein the length (d) of the circular-cylindrical section corresponds to 0.1 to 1.0 times the diameter (e) of the outlet opening.

17. A flat jet nozzle as defined in claim 4, wherein the length (d) of the circular-cylindrical section corresponds to 0.1 to 1.0 times the diameter (e) of the outlet opening.

18. A flat jet nozzle as defined in claim 1, wherein the outlet opening is surrounded by a protective ring downstream of and in spaced relation to the outlet opening.

19. A flat jet nozzle as defined in claim 18, wherein the inside diameter (f) of said protective ring corresponds to 1.5 to 10 times the diameter (e) of the outlet opening.

20. A flat jet nozzle as defined in claim 18, wherein the length (g) of said protective ring in the direction of flow corresponds to 0.2 to 5 times the diameter (e) of the outlet opening.

* * * * *